United States Patent [19]

Weber et al.

[11] Patent Number: 4,545,744

[45] Date of Patent: Oct. 8, 1985

[54] PERISTALTICALLY OPERATING ROLLER PUMP

[75] Inventors: Wolfram Weber, Spiesen-Elversberg; Hans-Jürgen Neumann; Artur Meisberger, both of St. Wendel; Bernd Mathieu, Spiesen-Elversberg, all of Fed. Rep. of Germany

[73] Assignee: Fresenius AG, Hamburg, Fed. Rep. of Germany

[21] Appl. No.: 633,798

[22] Filed: Jul. 24, 1984

[30] Foreign Application Priority Data

Jul. 25, 1983 [DE] Fed. Rep. of Germany ..... 3326784

[51] Int. Cl.[4] ..... F04B 43/12; F04B 45/08

[52] U.S. Cl. ..... 417/475; 417/477

[58] Field of Search ..... 417/475, 476, 477

[56] References Cited

U.S. PATENT DOCUMENTS

| | | | |
|---|---|---|---|
| 3,502,034 | 3/1970 | Pickup | 417/477 X |
| 3,841,799 | 10/1974 | Spinosa et al. | 417/477 |
| 3,927,955 | 12/1975 | Spinosa et al. | 417/477 |
| 3,963,023 | 6/1976 | Hankinson | 417/477 X |
| 4,179,249 | 12/1979 | Guttmann . | |

FOREIGN PATENT DOCUMENTS

| | | | |
|---|---|---|---|
| 0107440 | 8/1984 | European Pat. Off. . | |
| 2641170 | 7/1977 | Fed. Rep. of Germany . | |
| 3227051 | 2/1984 | Fed. Rep. of Germany . | |
| 1208712 | 10/1970 | United Kingdom | 417/477 |
| 2012373 | 7/1979 | United Kingdom . | |

*Primary Examiner*—Richard E. Gluck

*Attorney, Agent, or Firm*—Pravel, Gambrell, Hewitt & Kimball

[57] ABSTRACT

A roller pump (1) comprises a stator member (2) in which a pump bed (3) is formed with specific geometry. In the interior of the pump bed (3) a rotor (6) is rotatably mounted. A pump hose (10) can be inserted into the pump bed (3), said hose being curved in loop-like manner and its two ends being combined in immediate vicinity to each other in a connecting piece (11). The connecting piece (11) can be fixed in location in the stator member (2), the arrangement in the stator member (2) being uniquely defined by cooperation of a location tongue (23) and a location slot (22). Interchanging of the pressure-side and suction-side connection is thus impossible. A holding-down member (24) arranged on the rotor (6) permits automatic insertion and ejection of the pump hose (10) or hose system (9).

14 Claims, 2 Drawing Figures

PERISTALTICALLY OPERATING ROLLER PUMP

The invention relates to a peristaltically operating roller pump, in particular a hose pump or squeezed tube pump in medical technology.

Roller pumps are preferred in medicine for pumping blood or other fluids, for example in dialysis or cell separators. They must have a high safety standard as well as foolproof operation.

In its basic concept a roller pump comprises a stator and a rotor. The stator is formed on the pump housing and comprises a depression against the continuously extending vertical bearing wall of which a pump hose bears. The area at which the pump hose bears on the bearing wall forms the pump bed which has the contour of a circular segment whose central angle is at least 360°/n, n being the number of rollers.

Through the centre point of this circular segment extends the axis of rotation of a rotor which comprises rollers rotatably mounted at its free ends. On rotation of the rotor in the operating direction the rollers come into contact with the pump hose which bears on the circular contour of the pump bed and on further rotation compress said hose to such an extent that it is sealed in fluid-tight manner. On further rolling of the rollers on the pump hose the pumped medium disposed in said hose is further conveyed.

The connection of the pump hose disposed in the roller pump to the outside to the remaining tubing complex is by means of standardized connectors which are mounted at a suitable point in the region of the pump bed on the pump housing so that a pressure-side and a suction-side connection is formed. The external tubing which is to conduct the medium to be pumped into the roller pump is fitted to the one input of the suction-side connection and the external tubing which is to carry the pumped medium away from the roller pump is also fitted to the one end of the pressure-side connection. The actual pump hose, which is usually made from a different material to the conveying tubing, must be cut to a suitable length, and the other end of the suction-side connection is then connected to the other end of the pressure-side connection via the pump hose, giving a closed cycle. Since the rollers mounted on the rotor form only a narrow gap between themselves and the bearing wall, insertion of the pump hose into the pump bed is a complicated procedure. Furthermore, on insertion of the pump hose into a roller pump of the type outlined above the following errors can occur: laterally inverted incorrect insertion, i.e. erroneous interchange of pressure-side and suction-side connection; insertion of the pump hose with different or unintended hose lengths within the pump; twisting of the pump hose about its central axis and insertion of the pump hose into a wrong position.

Roller pumps are known in which constructional steps have been taken in an attempt to facilitate the insertion of the pump hose. For example, U.S. Pat. No. 4,211,519 discloses a roller pump in which the pump bed can be detached from the drive part and furthermore the pump bed is formed from two pivotal connected half shells which in the closed state surround the pump rotor with the rollers mounted thereon. On insertion of a pump hose the pump bed is removed from the drive part and thereafter the two half shells pivoted apart so that the rotor is freely accessible. The pump hose is then led round the rotor either from the front or from above and then the two half shells are again closed so that the pump hose comes to bear on the inner peripheral surface of the two half shells. The pressure-side and suction-side connections of the pump hose are led outwardly through two openings formed in the peripheral wall of the half shells, the two connections being combined in immediate mutual vicinity after closing of the two half shells. The pump bed is then secured to the drive part, simultaneously securing the closed position of the two half shells and the drive shaft of the rotor comes into engagement with the driven shaft of the drive part.

A peristaltically operating roller pump constructed in this manner has two substantial disadvantages: Firstly, the insertion of a new pump hose is extremely complicated and time-consuming because at least four screws must be released; the pump bed must be removed from the drive part and opened and thereafter the pump hose must be inserted by hand round the rotor, and it must be ensured firstly that the inserted hose segment is not too short and not too long and secondly that the pump hose after closing of the two half shells bears properly on the bearing wall of the pump bed, i.e. on the inner peripheral surface of the two half shells. Furthermore, it must be ensured that the pump hose is led properly in the two passage openings and held to prevent any wandering of the pump hose during operation of the roller pump.

In addition, there is the substantial disadvantage that only a pump hose with definite outer diameter can be used because a thinner pump hose is no longer properly held in the two passage openings and a thicker pump hose would be clamped or squeezed in the passage openings. Thus, a separate pump bed must be kept in readiness for each hose diameter.

The problem underlying the present invention is to provide a peristaltically operating roller pump whose pump hose compared with the roller pump of U.S. Pat. No. 4,211,519 can be inserted more rapidly and always held in the same manner reliably and reproduceably.

Because the pump hose is immovably secured to the connection piece to form a premade hose system and furthermore the connection piece can be detached from the pump bed, the disadvantages of the prior art corresponding to the preamble are eliminated.

The formation of a premade hose system consisting of the pump hose and the connecting piece makes it possible to insert the pump hose into the pump bed with a few manipulations, and no adjustments need be made to the pump bed or to the rotor diameter. In particular, the problems occurring in conventional roller pumps such as overextension or twisting of the pump hose are eliminated because a pump hose of exact length is undetachably secured to the connecting piece. It is thus ensured that only a pump hose with a length optimum for the pump bed can be inserted. Furthermore, because of the reliable securing of the two hose ends to the connecting piece it is ensured that twisting of the pump hose about its longitudinal axis during the insertion operation is almost impossible. If during the insertion a twisting of the pump hose should occur, because the ends of the pump hose are fixed in location at the connecting piece after a few revolutions of the rotor the pump hose untwists itself automatically. Furthermore, because of the immovable securing of the pump hose to the connecting piece the hose is reliably fixed in location in the pump bed during operation of the roller pump. Since the connecting piece can be detached from the pump bed, pump hoses of various diameters can be used because on changing the pump hose at the same time the corresponding matching connecting piece is also changed.

The subsidiary claims set forth advantageous further developments.

Since the rotor comprises in its peripheral regions between two adjacent rollers a radially outwardly directed holding-down member, insertion of the pump hose is carried out automatically. The automatic insertion or threading of the pump hose by means of the holding-down member is fundamentally possible with any pump hose but the use of the threading-in means in combination with the roller pump according to the invention is found to be particularly advantageous.

Also particularly advantageous is the use of a premade loop-shaped hose system which represents a part which can be independently handled and is individualized in function in accordance with the invention.

Further details, features and advantages of the invention will be apparent from the following description of an embodiment with the aid of the drawings.

Figure 1:
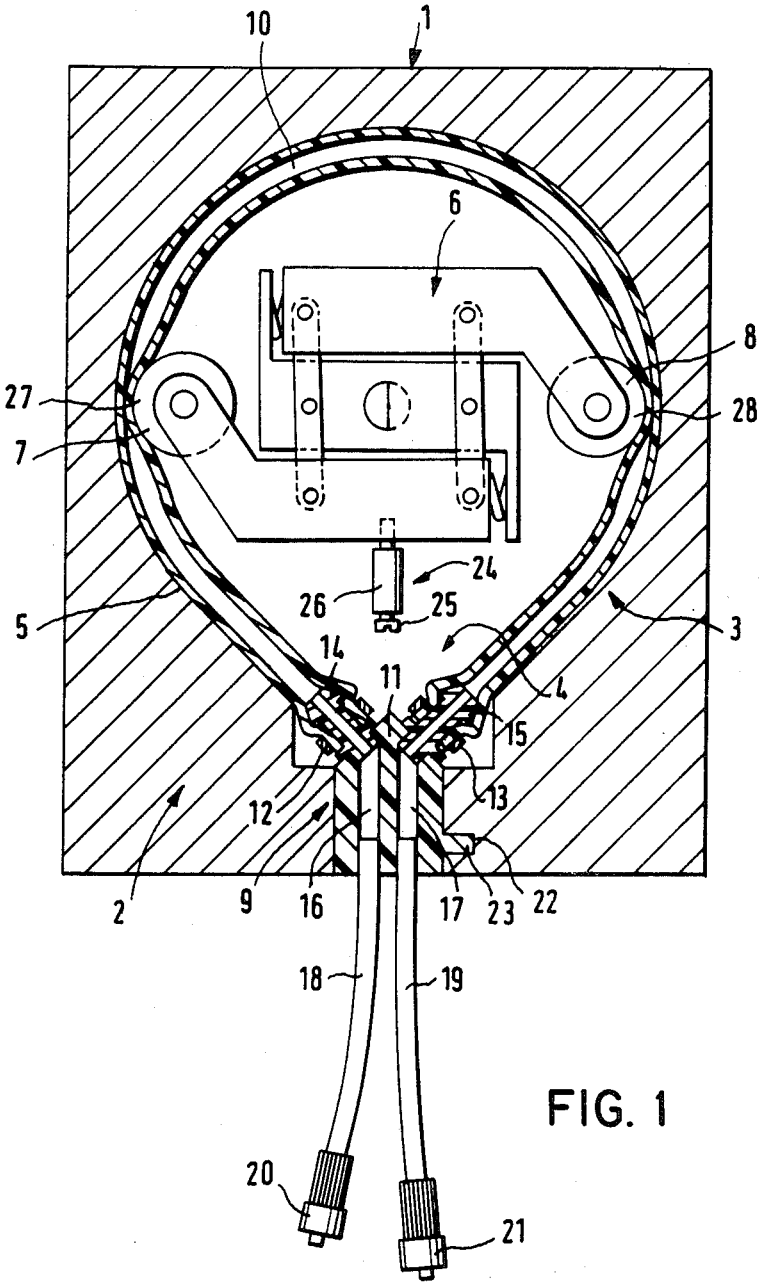
FIG. 1 is an elevational view partially in cross section.

A roller pump 1 comprises essentially a stator member 2 in which a pump bed 3 is formed. The pump bed 3 is formed as depression in the stator member 2 with a bottom surface 4 extending parallel to the surface of the stator member 2 and a bearing wall 5 upright with respect to the bottom surface 4. At the geometrical centre of the pump bed 3 a rotor 6 is rotatably mounted. Rotatably mounted on the rotor 6 are two rollers 7, 8. For further details regarding the construction and function of the rotor and the pump bed attention is drawn to the complete content of the parallel patent application of the same applicants, U.S. patent application Ser. No. 633,804 filed July 24, 1984, under the title "Peristaltically operating roller pump and pump rotor therefor".

A hose system 9 is disposed in the pump bed 3, i.e. the stator member 2. The hose system 9 comprises a pump hose 10 which is disposed in the pump bed 3 and bears on the bearing wall 5 thereof and is bent in loop-like manner and the ends of which are combined in immediate vicinity to each other in a common connecting piece 11. The securing of the pump hose 10 to the connecting piece 11 is by means of hose clips 12, 13 or the like which compress and thus secure the pump hose 10 which is pushed over two projecting studs 14 and 15. The studs 14 and 15 are disposed on the connecting piece 11 substantially so that they point in the direction in which the pump hose 10 extends. Within the connecting piece 11 two passages 16 and 17 are formed which are in contact with the studs or nipples 14 and 15 in such a manner that the medium to be pumped by the roller pump 1 can flow unrestricted. In the outlet openings of the two passages 16 and 17 two connecting tubes 18 and 19 are permanently attached, for example by adhesive. The two connecting tubes 18 and 19 have at their free ends a suitable, in particular standardized, member of a tube coupling, 20, 21, for example a Luer cone. In the immediate vicinity of the connecting piece 11 the stator member comprises a location slot 22 into which a location tongue 23 projecting asymmetrically at the connecting piece 11 can engage. The engagement of the location tongue 23 in the slot 22 ensures firstly that the hose system 9 due to the coded configuration of the connecting piece 11 is always correctly inserted into the roller pump 11 and secondly by the positive connection between the connecting piece 11 and the stator member 2 that the hose system 9 is fixed in location in the roller pump 1.

The rotor 6 comprises in its peripheral region between two adjacent rollers 7 and 8 a holding-down member 24 which with respect to the axis of rotation of the rotor 6 projects radially into the region of the pump hose 10 and is arranged axially above said hose 10. The holding-down member 24 consists of a pin 25 which is secured in suitable manner, for example by screwing in, to the rotor 6. The pin 25 is provided at the periphery with a pressure roller 26 which is mounted for radial rotation with respect to the axis of rotation of the rotor 6.

The mode of operation of the holding-down member 24 is as follows:

The hose system 9 with the pump hose 10 is not yet in the roller pump 1; the rotor 6 is set manually or automatically so that the holding-down member 24 points in the direction of the subsequent position of the connecting piece 11. The hose system 9 is inserted by lateral pushing in of the connecting piece 11, the location tongue 23 coming into engagement with the location slot 22. The holding-down member 24 is arranged on the rotor 6 in such a manner that the connecting member 11 after complete insertion into the stator member 2 with respect to the axis of rotor 6 is axially closer to the bottom surface 4 than the holding-down member 24. Because of the flexibility inherent in its material in this position of the rotor 6 the pump hose is curved, i.e. the pump hose 10 lies in the regions 27 and 28 on the two rollers 7 and 8 and on either side extends inclined downwardly in the direction towards the connecting member 11. On subsequent rotation of the rotor 6 the holding-down member 24 contacts the pump hose 10 forcing the pump hose 10 into the proper orientation within the pump bed 3 against bearing wall 5.

The threading out or ejection of the pump hose 10 is in the converse order, i.e. the rotor 6 is again brought manually or automatically into the position described above, the connecting piece 11 is lifted from the stator member 2 and on a subsequent rotation of the rotor 6 the holding-down member 24 engages the pump hose 10 from below and lifts said hose out of the pump bed 3.

The principle of the connecting piece 11 in conjunction with the annular arrangement of the hose system 9 also has the advantage that the pump hose 10 can be inserted with exact and constant length into the roller pump 1 and thus a maximum of absolute accuracy of the desired flow rate is ensured.

Figure 2:
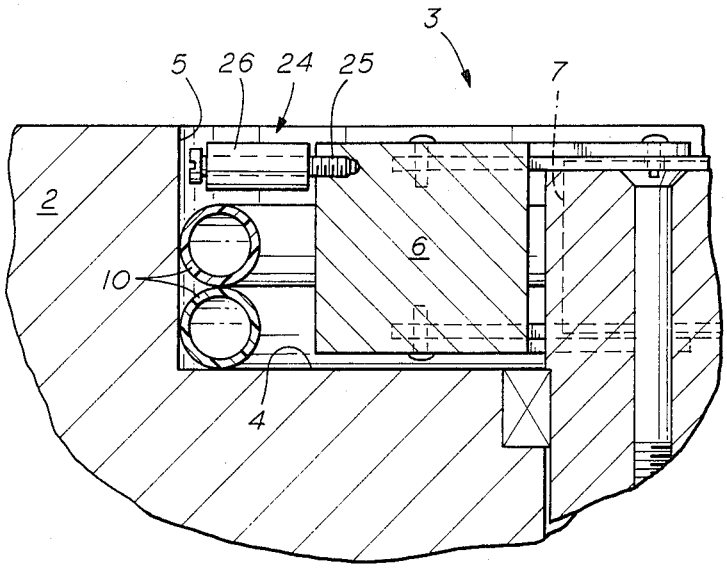
FIG. 2 is a cross-sectional view of the present invention when employed with two adjacent parallel hoses.

On insertion of two pump hoses 10 (see FIG. 2) of exactly the same length with the hose system 9 excellent substitution takes place of the required amounts, i.e. a delivery and removal of exactly equal volumes as required in medicine for example when substituting blood components.

Due to the geometry of the connecting piece 11 with the asymmetrically projecting location tongue 23 the pump hose 10 is located in the pump bed 3 in such a manner that unnecessary movements of the hose 10 during operation are avoided.

With extremely safe and reliable roller pumps having a rigid stator and a fully occluding rolling of the rotor the automatic insertion means considerably simplifies the handling and even further increases the reliability.

We claim:

1. Peristaltically operating roller pump comprising:
a pump bed;
a rotatably driven rotor carrying at its periphery rotatable rollers; and
a pump hose disposed between a pressure-side connection and a suction-side connection oriented radially outside the rollers along an inner bearing wall of the pump bed whereby in the region of the rollers the pump hose is pressed against the bearing wall and thereby occluded, the pressure-side connection and the suction-side connection being in immediate vicinity of each other and arranged to form said pump hose into a loop like arc combined in a common connecting piece which is releasably fixed in location at the pump bed, characterized in that the connecting piece is detachable from the pump bed and that the pump hose is immovably secured to the connecting piece to form a premade hose system.

2. Roller pump according to claim 1, characterized in that the connecting piece is made in one part of a plastic moulding.

3. Roller pump according to claim 1, characterized in that at the side of the connecting piece opposite the pump hose two connecting tubes are permanently disposed and are provided at their free ends with a suitable hose coupling means.

4. Roller pump according to claim 1, characterized in that the connecting piece can be fixed only in a predetermined position at the pump bed.

5. Roller pump according to claim 4, characterized in that the predetermined position of the connecting piece is defined by its configuration.

6. Roller pump according to claim 5, characterized in that the connecting piece comprises an asymmetrically projecting location tongue adapted to engage in a location slot in the pump bed.

7. Roller pump according to claim 3, characterized in that along the inner bearing wall of the pump bed two identical premade hose systems each having a connecting piece can be arranged axially adjacent to each other and parallel to each other.

8. Roller pump according to claim 1, characterized in that the rotor comprises in its peripheral region between two adjacent rollers a holding-down member which projects radially into the region of the pump hose and is disposed axially above the latter.

9. Roller pump according to claim 8, characterized in that the holding-down member is made pin-shaped.

10. Roller pump according to claim 8 or 9, characterized in that the holding-down member comprises a pressures roller rotatable about a radial axis.

11. Roller pump according to claim 10, characterized in that the pressure roller comprises a plastic material.

12. Hose system for a peristaltically operating roller pump according to claim 1, characterized in that the pump hose is secured immovably to the connecting piece to form a premade hose system.

13. Roller pump according to claim 1, characterized in that the pump hose is presecured to the connecting piece and is of such a length so as to form a loop-like arcuate pump hose so as to fit within the pump bed substantially in contact with the inner bearing wall.

14. The peristaltically operating roller pump of claim 1, characterized in that the rotor comprises in the peripheral region between two adjacent rollers a holding down member which projects radially almost to the bearing wall and is disposed in an axial position from said rotor in an alignment to orient said pump hose in said pump bed.

* * * * *